US009611823B2

(12) United States Patent
Schwarte et al.

(10) Patent No.: US 9,611,823 B2
(45) Date of Patent: Apr. 4, 2017

(54) METHOD FOR CONTROLLING THE INJECTION QUANTITY OF A PIEZOINJECTOR OF A FUEL INJECTION SYSTEM

(75) Inventors: Anselm Schwarte, Bad Abbach (DE); Steffen Lehner, Eichstätt (DE); Manfred Kramel, Mintraching (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 677 days.

(21) Appl. No.: 13/820,762

(22) PCT Filed: Aug. 24, 2011

(86) PCT No.: PCT/EP2011/064567
§ 371 (c)(1),
(2), (4) Date: May 20, 2013

(87) PCT Pub. No.: WO2012/031896
PCT Pub. Date: Mar. 15, 2012

(65) Prior Publication Data

US 2013/0233936 A1 Sep. 12, 2013

(30) Foreign Application Priority Data

Sep. 6, 2010 (DE) ..... 10 2010 040 283

(51) Int. Cl.
*B05B 17/04* (2006.01)
*F02M 51/00* (2006.01)
(Continued)

(52) U.S. Cl.
CPC ..... *F02M 51/00* (2013.01); *F02D 41/2096* (2013.01); *F02D 2041/1409* (2013.01);
(Continued)

(58) Field of Classification Search
CPC ..... F02M 51/00
(Continued)

(56) References Cited

U.S. PATENT DOCUMENTS 6,680,620 B2 * 1/2004 Hedenetz et al. ..... 324/727
6,772,735 B2 8/2004 Boss et al. ..... 123/467
(Continued)

FOREIGN PATENT DOCUMENTS

DE 10035815 A1 1/2002 ..... F02D 41/20
DE 10306458 A1 8/2004 ..... F02D 41/20
(Continued)

OTHER PUBLICATIONS

International Search Report and Written Opinion, Application No. PCT/EP2011/064567, 12 pages, Nov. 9, 2011.

*Primary Examiner* — Jason Boeckmann
*Assistant Examiner* — Adam J Rogers
(74) *Attorney, Agent, or Firm* — Slayden Grubert Beard PLLC

(57) ABSTRACT

A method for controlling the injection quantity of a piezoinjector of a fuel injection system, which comprises a nozzle needle displaceable by a piezoactuator. Based on the instantaneous injection quantity, a selection is made among various control methods. In a ballistic injector mode, a first control method is carried out, wherein both a needle closing point in time is equalized and a needle travel time is also equalized. In a full stroke injector mode, a second control method is carried out, wherein a needle closing point in time is equalized, but the needle travel time is not equalized.

9 Claims, 3 Drawing Sheets

(51) Int. Cl.
*F02D 41/20* (2006.01)
*F02D 41/14* (2006.01)

(52) U.S. Cl.
CPC ..... *F02D 2041/2031* (2013.01); *F02D 2041/2055* (2013.01)

(58) Field of Classification Search
USPC ..... 239/4
See application file for complete search history.

(56) References Cited

U.S. PATENT DOCUMENTS

| | | | | |
|---|---|---|---|---|
| 8,239,119 | B2 * | 8/2012 | Bagnasco | F02D 41/2438 701/103 |
| 2005/0067503 | A1 * | 3/2005 | Katase | 239/373 |
| 2006/0289670 | A1 * | 12/2006 | Beilharz et al. | 239/88 |
| 2007/0069043 | A1 * | 3/2007 | Bogner | 239/102.2 |
| 2007/0248468 | A1 * | 10/2007 | Holmberg | 417/44.2 |
| 2009/0038590 | A1 * | 2/2009 | Fukushima | 123/494 |
| 2010/0320284 | A1 * | 12/2010 | Okamura | 239/102.2 |
| 2013/0233936 | A1 | 9/2013 | Schwarte et al. | 239/5 |

FOREIGN PATENT DOCUMENTS

| | | | | |
|---|---|---|---|---|
| DE | 10323488 | A1 | 12/2004 | F02D 41/20 |
| DE | 102008040222 | A1 | 1/2010 | F02D 41/22 |
| EP | 1400675 | A1 | 3/2004 | F02D 41/20 |
| WO | 2012/031896 | A1 | 3/2012 | F02D 41/20 |

* cited by examiner

METHOD FOR CONTROLLING THE INJECTION QUANTITY OF A PIEZOINJECTOR OF A FUEL INJECTION SYSTEM

CROSS-REFERENCE TO RELATED APPLICATIONS

This application is a U.S. National Stage Application of International Application No. PCT/EP2011/064567 filed Aug. 24, 2011, which designates the United States of America, and claims priority to DE Application No. 10 2010 040 283.4 filed Sep. 6, 2010, the contents of which are hereby incorporated by reference in their entirety.

TECHNICAL FIELD

The disclosure relates to a method for controlling the injection quantity of a piezoinjector, having a piezo actuator and a nozzle needle which can be moved by the piezo actuator, of a fuel injection system.

BACKGROUND

Common-rail fuel injection systems which operate with directly driven injectors are already known. In such injectors, the primary actuator which has a drive according to the piezoelectric principle acts mechanically directly on the nozzle needle of the respective piezoinjector. Owing to mechanical force reactions from the nozzle needle on the actuator, the latter can also be used as a sensor. As a result it is possible to detect precisely the closing time of the nozzle needle and to use it as a controlled variable for the injection quantity of the piezoinjector.

In order to be able to ensure a high level of injection quantity accuracy, there is a need for control of the injection quantity which detects and corrects or compensates component tolerances, wear variables and interference variables, in particular component temperatures, of the piezoinjector.

SUMMARY

One embodiment provides a method for controlling the injection quantity of a piezoinjector, having a piezo actuator and a nozzle needle which can be moved by the piezo actuator, of a fuel injection system, wherein switching over between different control methods occurs as a function of the instantaneous injection quantity.

In a further embodiment, a first control method is carried out in a ballistic injector operating mode in which small injection quantities occur, and a second control method is carried out in a full stroke injector operating mode in which large injection quantities occur.

In a further embodiment, during the execution of the first control method equal settings of both the needle closing time and of the needle flight time are implemented, and during the execution of the second control method equal settings of the needle closing time are implemented but not of the needle flight time.

In a further embodiment, during the execution of the first control method a PI controller is used, and during execution of the second control method a P controller is used.

In a further embodiment, during the execution of the first control method a chronological change of the starting time of the electrical actuation of the piezoelectric actuator is implemented.

In a further embodiment, the chronological change in the starting time of the electrical actuation of the piezoelectric actuator is implemented in such a way that the needle flight time corresponds to a reference needle flight time.

In a further embodiment, the reference needle flight time is determined using a reference piezoinjector, and in that data describing the reference needle flight time is stored in a non-volatile fashion in a memory.

In a further embodiment, during the execution of the second control method a chronological change in the needle closing time is implemented.

In a further embodiment, the chronological change in the needle closing time is implemented in such a way that the needle closing time corresponds to a reference needle closing time.

In a further embodiment, the reference needle closing time is determined using a reference piezoinjector, and data describing the reference needle closing time is stored in a non-volatile fashion in a memory.

BRIEF DESCRIPTION OF THE DRAWINGS

Exemplary embodiments will be explained in more detail below based on the schematic drawings, wherein.

DETAILED DESCRIPTION

Embodiments of the present disclosure provide a method for controlling the injection quantity of a piezoinjector of a motor vehicle injection system in which the accuracy of the injection quantity is increased.

In some embodiments, the switching over makes it possible to use different control methods as a function of the instantaneous injection quantity and to configure them in such a way that accuracy of the injection quantity compared to known methods is increased. The disclosed method may distinguish between a ballistic injector operating mode in which small injection quantities occur and a full stroke injector operating mode in which large injection quantities occur. In the ballistic injector operating mode a first control method is executed, and in the full stroke injector operating mode a second control method is executed. The first control method is distinguished by the fact that equal settings of both the needle closing time and of the needle flight time are implemented. The needle flight time corresponds to the time period between the time at which discharging of the electrical actuator signal of the actuator starts and the time of the end of the injection. The second control method is distinguished by the fact that equal settings of the needle closing time are implemented but not of the needle flight time.

This switching over of the controller structure may result in a significant increase in the accuracy of the injection quantity. In particular, the method may ensure that in the case of ballistic needle movement the deviations of the injection quantity from the respectively requested injection quantity are greatly reduced for small injection quantities. Since the number of injections with small injection quantities is high in the case of multiple injections, this large reduction in the deviations of the injection quantity from the requested injection quantity in the ballistic injector operating mode may be highly significant for the practice.

Figure 1:
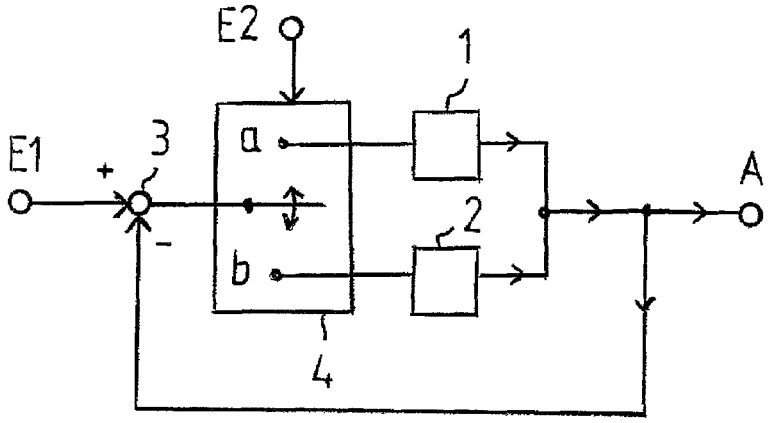
FIG. 1 shows a block illustration of a control device according to an example embodiment.

FIG. 1 shows a block illustration of a control device according to an example embodiment. This control device has a first input E1, a second input E2, an output A, a first controller 1, a second controller 2, a subtractor 3 and a switch 4 which has switched positions a and b.

A set point value T_OPP4S for the needle flight time of the injector needle of the piezoinjector is fed to the input E1 of the control device, said set point value T_OPP4S being made available by a superordinate control unit and being dependent on the respectively present driver's request. An actual value T_OPP4I for the needle flight time of the injector needle of the piezoinjector can be made available at the output A of the control device and can be used, for example, for the purpose of onboard diagnosis or for the purpose of display on a display. Furthermore, this actual value T_OPP4I is fed back to the subtractor 3 and subtracted therein from the set point value T_OPP4S. The difference signal which is obtained in the process is fed to the switch 4.

The switch 4 can be switched, by means of a switch control signal which is fed to the device shown in FIG. 1 via the input E2 thereof, into a switched position a or a switched position b. This switch control signal is also made available by the superordinate control unit. If a small injection quantity is present at a particular time, the switch control signal switches the switch 4 into its switched position a. If a large injection quantity is present at a particular time, the switch control signal switches the switch 4 into its switched position b.

A small injection quantity is present in the ballistic injector operating mode in which the piezoelectric actuator is energized in such a way that the injector needle does not fly as far as its needle stop. In this ballistic injector operating mode, the injector nozzles of the piezoinjector are only partially opened, with the result that a small fuel quantity is injected into an associated cylinder of the motor vehicle. This is the case when the fuel injection system is in a partial stroke operating mode. In this ballistic injector operating mode, the switch 4 is in its switched position a, with the result that the controller 1 is activated. The controller 1 carries out a first control process in which a chronological change of the needle closing time is performed, and in which a chronological change of the starting time of the electrical actuation of the piezoelectric actuator is also implemented.

This first control method is carried out by means of a PI controller. During the first control method, a chronological change of the starting time may take place with a corresponding change of the actuation period of the electrical actuation of the piezoelectric actuator in such a way that the needle flight time corresponds to a reference needle flight time. This reference needle flight time is determined by the manufacturer of the piezoinjector using a reference piezoinjector. Data describing this reference time is stored in a non-volatile fashion in the form of a characteristic diagram in a memory, with the result that said data is available during operation of the fuel injection system.

A large injection quantity is present in a full stroke operating mode of the fuel injection system in which the injection nozzles of the piezoinjector are completely opened and the injector needle is at its opened needle stop. In the full stroke operating mode the switch 4 is in its switched position b, with the result that the controller 2 is activated. The controller 2 carries out a second control method in which a chronological change of the needle closing time is performed but the needle flight time is not changed. This second control method is carried out by means of a P controller. During the second control method, a chronological change of the needle closing time may be carried out in such a way that the needle closing time corresponds to a reference needle closing time. This reference needle closing time is determined by the manufacturer of the piezoinjector using a reference piezoinjector. Data describing this reference needle closing time is stored in a non-volatile fashion in a memory, with the result that said data is available during operation of the fuel injection system.

Figure 2:
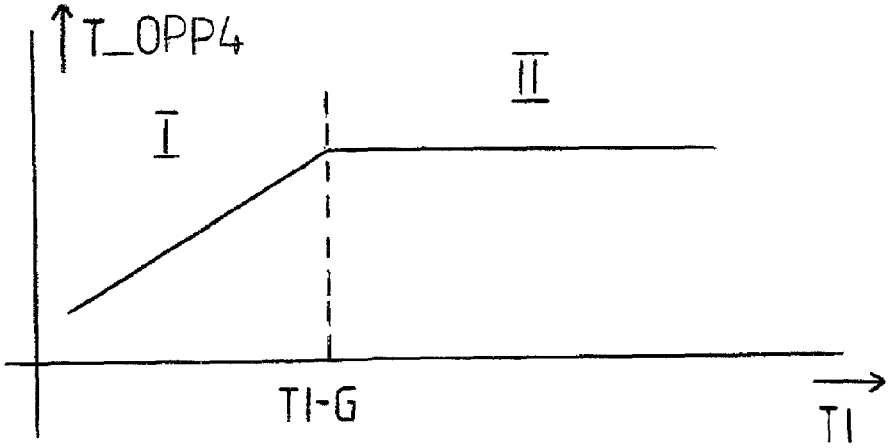
FIG. 2 shows a diagram of the needle flight time T_OPP4 plotted over the actuation period TI in order to illustrate the basic profile of the behavior of the controlled section of the control device.

FIG. 2 shows a diagram illustrating the basic profile of the behavior of the controlled section of the control device. In this context, a duration TI of the electrical actuation of the actuator is plotted along the abscissa, and the needle flight time T_OPP_4 is plotted along the ordinate. According to the illustrated diagram, a ballistic range I and a full stroke range II are provided. The ballistic range is available for actuation periods which are shorter than a limiting value TI-G denoted by dashed lines. The full stroke range is present for actuation periods which are longer than the limiting value TI-G.

In the ballistic range I, the needle flight time increases at least substantially linearly as the actuation period increases. In the full stroke range II the injector needle is at its stop and the needle flight time does not increase any more or remains constant.

In the ballistic range, i.e., when there is a small injection quantity at a particular time, control is carried out with the effect of implementing equal settings both of a needle closing time and of a needle flight time, and in the full stroke range, i.e. when there is a large injection quantity at a particular time, control is carried out with the effect of implementing equal settings for a needle closing time, wherein when the value TI-G for the actuation period is exceeded, switching over from the ballistic controller mode into the full stroke controller mode takes place.

Figure 3:
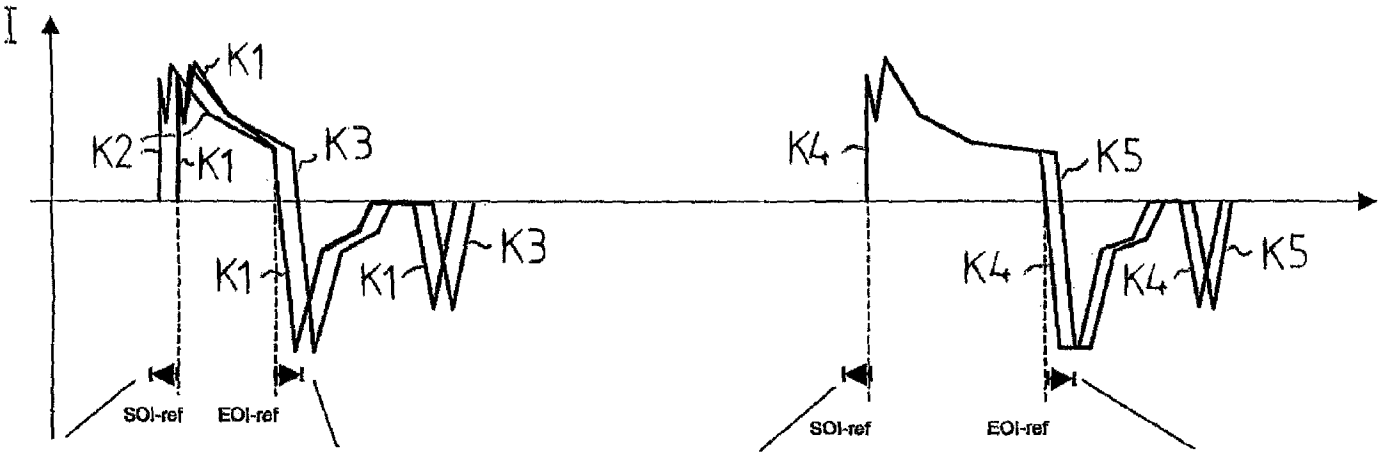
FIG. 3 shows a diagram illustrating control with simultaneous correction of the start of the injection and of the injection time as well as control during which a correction of the injection time is exclusively performed.

FIG. 3 shows a diagram illustrating control with simultaneous correction of the start of the injection and of the injection time and control in which correction of the injection time is exclusively performed. In this diagram, the current which is fed to the piezoactuator of the injector is plotted along the ordinate.

The ballistic controller mode is illustrated on the left-hand side of FIG. 3. In this context, the curve K1 represents a reference current profile corresponding to the current characteristic curve of a conventional control method. The curve K2 illustrates the correction of the starting time of the electrical actuation of the piezoelectric actuator with the effect of moving the starting time forward. In this context, the following relationship applies:

$$TI_OFS_CTL_SOI_COR[cyl,inj]=I\text{-Control}+K(TI,PFU)\cdot P\text{-Control}.$$

The curve K3 illustrates the correction of the needle closing time with the effect of shifting the timing of the needle closing time. In this context, the following relationship applies:

$$TI_OFS_CTL_TI_CTL[cyl,inj]=1\cdot P\text{-control } O, \text{ for steady state.}$$

On the right-hand side of FIG. 3, the full stroke controller mode is illustrated. In this case, the curve K4 represents a reference current profile. The following relationship applies:

$$TI_OFS_CTL_SOI_COR[cyl,inj]=0$$

The curve K5 illustrates the correction of the needle closing time with the effect of shifting the timing of the needle closing time. In this context, the following relationship applies:

$$TI_OFS_CTL_TI_CTL_[cyl,inj]=1\cdot P\text{-Control}.$$

In both illustrations in FIG. 3, the reference values are illustrated by dashed lines. SOI-ref is a reference value for the start of the injection, and EOI-ref is a reference value for the end of the injection.

Figure 4:
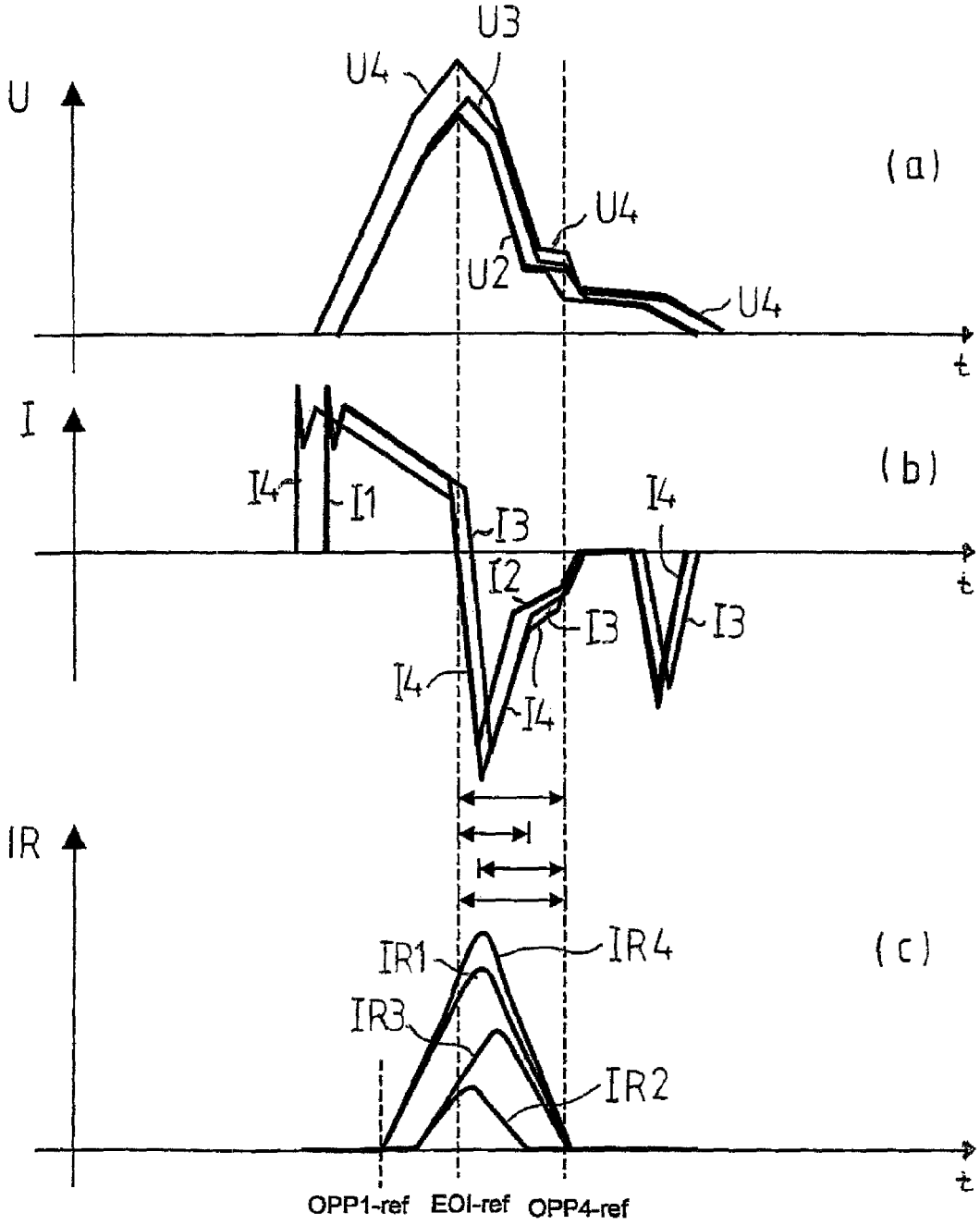
FIG. 4 shows diagrams illustrating the control principle for implementing equal settings of the needle closing time and of the needle flight time in the case of the ballistic injector operating mode.

FIG. 4 shows diagrams illustrating the control principle for implementing equal settings of the needle closing time and of the needle flight time.

In this context, in the diagram according to FIG. 4*a* the actuation voltage U of the actuator of the piezoinjector is plotted over the time t. In the diagram according to FIG. 4*b*, the actuation current I of the actuator is plotted over the time. In the diagram according to FIG. 4*c*, the injection rate IR of the piezoinjector is plotted over the time t.

In the diagram according to FIG. 4*a*, a total of four voltage profiles are shown, wherein the voltage profile U1 is associated with a reference injection, the voltage profile U2 with the application of an open control loop, the voltage profile U3 with a conventional control and the voltage profile U4 with a control according to an example embodiment. It is apparent that the voltage profile U4 starts chronologically before the other voltage profiles and ends last in chronological terms.

In the diagram according to FIG. 4*b* a total of four current profiles are shown, wherein the current profile I1 describes a reference current profile, the current profile I2 describes the application of an open control loop, the current profile I3 describes a current profile when only the needle closing time is shifted, and the current profile I4 describes a current profile according to an example embodiment.

In the diagram according to FIG. 4*c*, a total of four injection rate profiles are shown, wherein the profile IR1 corresponds to a reference profile, the profile IR2 corresponds to the profile when an open control loop is applied, the profile IR3 corresponds to a control with shifting of the timing of the needle closing time, and profile IR4 corresponds to a control with the starting time of the electrical actuation of a piezoelectric actuator being moved forward and with shifting of the timing of the needle closing time.

In the lower diagram, a reference value OPP1-ref for the needle opening time OPPI, a reference value OPP4-ref for the needle closing time OPP4 and a reference value EOI-ref for the end of the injection are specified along the time axis t.

As a result of the implementation of equal settings both of a needle closing time and of a needle flight time as disclosed herein, the injection quantity of a respective piezoinjector is individually adapted to a predefined reference value which has been determined by the manufacturer of the piezoinjector on the basis of a reference piezoinjector and stored in a non-volatile fashion in a memory, and is therefore available during operation of the motor vehicle for the execution of a method as disclosed herein. This individual adaptation of the needle closing time and of the needle flight time of a piezoinjector to the respectively predefined reference value corrects and/or compensates component tolerances, wear variables and interference variables, and in particular temperature changes of components of the piezoinjector.

What is claimed is:

1. A method for controlling an injection quantity of a piezoinjector of a fuel injection system, the piezoinjector having a piezo actuator and a nozzle needle which can be moved by the piezo actuator, the method comprising:

receiving, at a switch, a signal indicating an instantaneous injection quantity, determining, by the switch, an instantaneous injection quantity based on the received signal, and automatically switching, by the switch, between a first and a second control method as a function of the instantaneous injection quantity, wherein the first control method includes setting a needle closing time to a reference closing time value and a needle flight time to a reference flight time value, and the second control method includes setting only the needle closing time to the reference closing time value.

2. The method of claim 1, comprising:

performing a first control method in a ballistic injector operating mode in which small injection quantities occur because the nozzle needle is only partially open, and performing a second control method in a full stroke injector operating mode in which large injection quantities occur because the nozzle needle is fully open.

3. The method of claim 1, comprising:

using a PI controller during the execution of the first control method, and using a P controller during execution of the second control method.

4. The method of claim 1, comprising implementing a chronological change of the starting time of the electrical actuation of the piezoelectric actuator during the execution of the first control method.

5. The method of claim 4, comprising implementing the chronological change in the starting time of the electrical actuation of the piezoelectric actuator such that the needle flight time corresponds to a reference needle flight time.

6. The method of claim 5, comprising determining the reference needle flight time using a reference piezoinjector, wherein data describing the reference needle flight time is stored in a non-volatile fashion in a memory.

7. The method of claim 1, comprising implementing a chronological change in the needle closing time during the execution of the second control method.

8. The method of claim 7, comprising implementing the chronological change in the needle closing time such that the needle closing time corresponds to a reference needle closing time.

9. The method of claim 8, comprising determining the reference needle closing time using a reference piezoinjector, and wherein data describing the reference needle closing time is stored in a non-volatile fashion in a memory.

* * * * *